US010553994B2

(12) United States Patent
Zhao et al.

(10) Patent No.: US 10,553,994 B2
(45) Date of Patent: Feb. 4, 2020

(54) ELECTRICAL CONNECTOR HAVING SEPARATE FRONT AND REAR SHIELDING SHELLS

(71) Applicant: FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/851,697

(22) Filed: Dec. 21, 2017

(65) Prior Publication Data

US 2018/0175559 A1 Jun. 21, 2018

(30) Foreign Application Priority Data

Dec. 21, 2016 (CN) ..... 2016 1 1191035
Dec. 21, 2016 (CN) ..... 2016 2 1415037 U

(51) Int. Cl.

| | |
|---|---|
| ***H01R 13/405*** | (2006.01) |
| ***H01R 13/6581*** | (2011.01) |
| ***H01R 13/6591*** | (2011.01) |
| ***H01R 13/506*** | (2006.01) |
| ***H01R 13/516*** | (2006.01) |
| ***H01R 12/72*** | (2011.01) |

(Continued)

(52) U.S. Cl.

CPC ..... *H01R 13/6591* (2013.01); *H01R 12/724* (2013.01); *H01R 13/506* (2013.01); *H01R 13/516* (2013.01); *H01R 13/6581* (2013.01); *H01R 24/50* (2013.01); *H01R 13/405* (2013.01); *H01R 13/5045* (2013.01); *H01R 24/60* (2013.01); *H01R 2107/00* (2013.01)

(58) Field of Classification Search

CPC ..... H01R 13/6582; H01R 13/6581; H01R 13/6593; H01R 13/6594; H01R 13/506; H01R 13/648; H01R 13/6598

See application file for complete search history.

(56) References Cited

U.S. PATENT DOCUMENTS

| | | | | |
|---|---|---|---|---|
| 9,748,701 | B2 * | 8/2017 | Tsai | H01R 24/62 |
| 10,164,379 | B2 * | 12/2018 | Duan | H01R 13/6585 |
| 2017/0331235 | A1 * | 11/2017 | Yokoyama | H01R 24/60 |

FOREIGN PATENT DOCUMENTS

| | | |
|---|---|---|
| CN | 101227042 A | 7/2008 |
| CN | 101364694 A | 2/2009 |

(Continued)

*Primary Examiner* — Vanessa Girardi

(74) *Attorney, Agent, or Firm* — Wei Te Chung; Ming Chieh Chang

(57) ABSTRACT

An electrical connector includes: a housing having a base and a frontal tongue, the base having a front part and a rear part; an upper and lower rows of contacts arranged in the housing and exposed respectively to two opposite surfaces of the tongue; and a front and rear shielding shells enclosing the housing, the rear part of the base extending rearwardly beyond the front shielding shell; wherein the rear shielding shell has an intermediate part, a front part continuing the intermediate part, a pair of side parts continuing the intermediate part, and a rear part continuing the intermediate part, or the rear shielding shell forwardly abuts the front shielding shell.

12 Claims, 20 Drawing Sheets

(51) Int. Cl.

| | |
|---|---|
| ***H01R 24/50*** | (2011.01) |
| *H01R 13/504* | (2006.01) |
| *H01R 107/00* | (2006.01) |
| *H01R 24/60* | (2011.01) |

(56) References Cited

FOREIGN PATENT DOCUMENTS

| | | | | | |
|---|---|---|---|---|---|
| CN | 102324642 | A | | 1/2012 | |
| CN | 102916304 | A | | 2/2013 | |
| CN | 204720724 | | | 10/2015 | |
| CN | 204809520 | | | 11/2015 | |
| CN | 105470699 | A | | 4/2016 | |
| CN | 106025683 | A | | 10/2016 | |
| JP | WO2016080010 | | * | 5/2016 | ..... H01R 24/50 |
| WO | WO2016080010 | | | 5/2016 | |

* cited by examiner

ELECTRICAL CONNECTOR HAVING SEPARATE FRONT AND REAR SHIELDING SHELLS

BACKGROUND OF THE INVENTION

1. Field of the Invention

The present invention relates to an electrical connector having a front shielding shell enclosing the housing with a rear part of the housing extending rearwardly beyond the front shielding shell and a separate rear shielding shell enclosing the rear part of the housing to have a better shielding effect.

2. Description of Related Arts

WO 2016/080010, published on May 26, 2016, discloses an electrical connector including a contact module, a shielding shell enclosing the contact module, and a rear shielding plate securely fixed to an insulative housing of the contact module or welded externally to the shielding shell.

China Patent No. 204720724 discloses an electrical connector including a shielding shell having an integral rear plate. Gaps exist between the rear plate and the remainder of the shielding shell.

SUMMARY OF THE INVENTION

An electrical connector comprises: a housing having a base and a frontal tongue, the base having a front part and a rear part; an upper and lower rows of contacts arranged in the housing and exposed respectively to two opposite surfaces of the tongue; and a front and rear shielding shells enclosing the housing, the rear part of the base extending rearwardly beyond the front shielding shell; wherein the rear shielding shell has an intermediate part, a front part continuing the intermediate part, a pair of side parts continuing the intermediate part, and a rear part continuing the intermediate part, or the rear shielding shell forwardly abuts the front shielding shell.

DETAILED DESCRIPTION OF THE PREFERRED EMBODIMENTS

Figure 1:
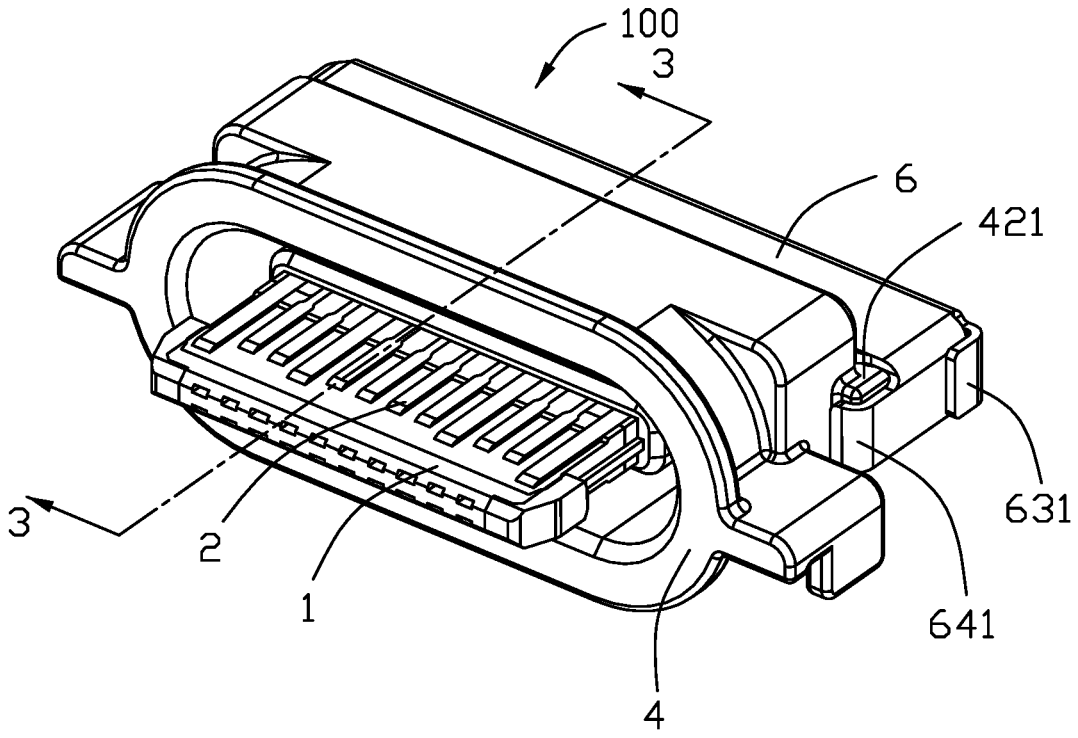
FIG. 1 is a front perspective view of an electrical connector in accordance with a first embodiment of the present invention.

Referring to FIGS. 1-10, an electrical connector 100 of a first embodiment comprises a housing 1, a plurality of contacts 2 arranged in the housing 1, and a front and rear shielding shells 4 and 6 enclosing the housing 1. The electrical connector 100 may further include a sealing element 5 sealed at a rear of the housing 1 and an interface gap among the housing 1 and the front and rear shielding shells 4 and 6.

Figure 2:
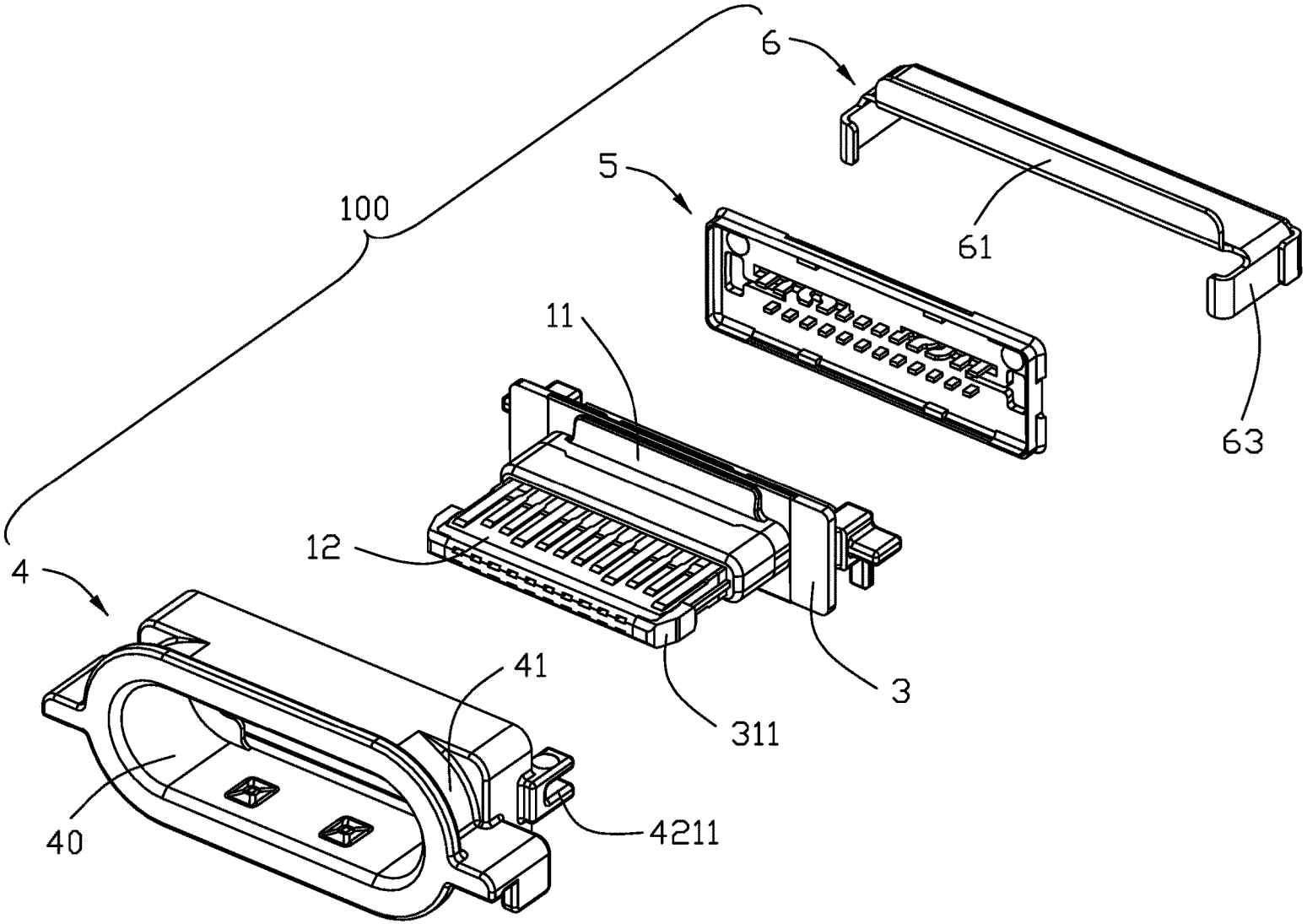
FIG. 2 is an exploded view of the electrical connector.
Figure 3:
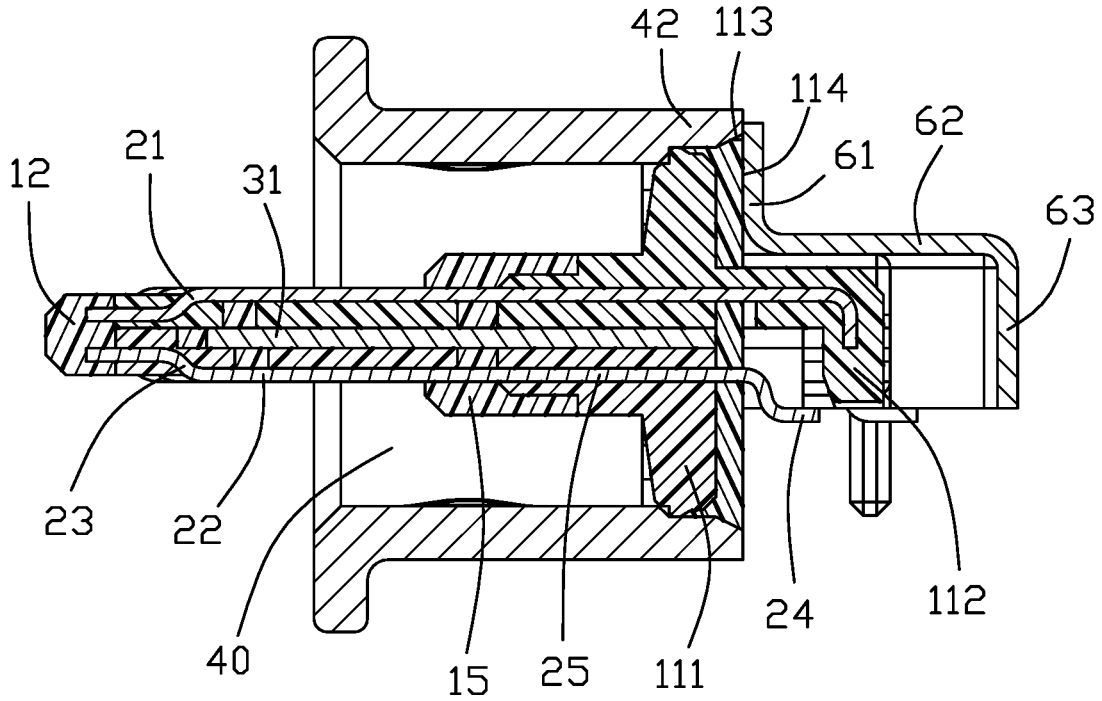
FIG. 3 is a cross-sectional view of the electrical connector taken along line A-A in FIG. 1.
Figure 4:
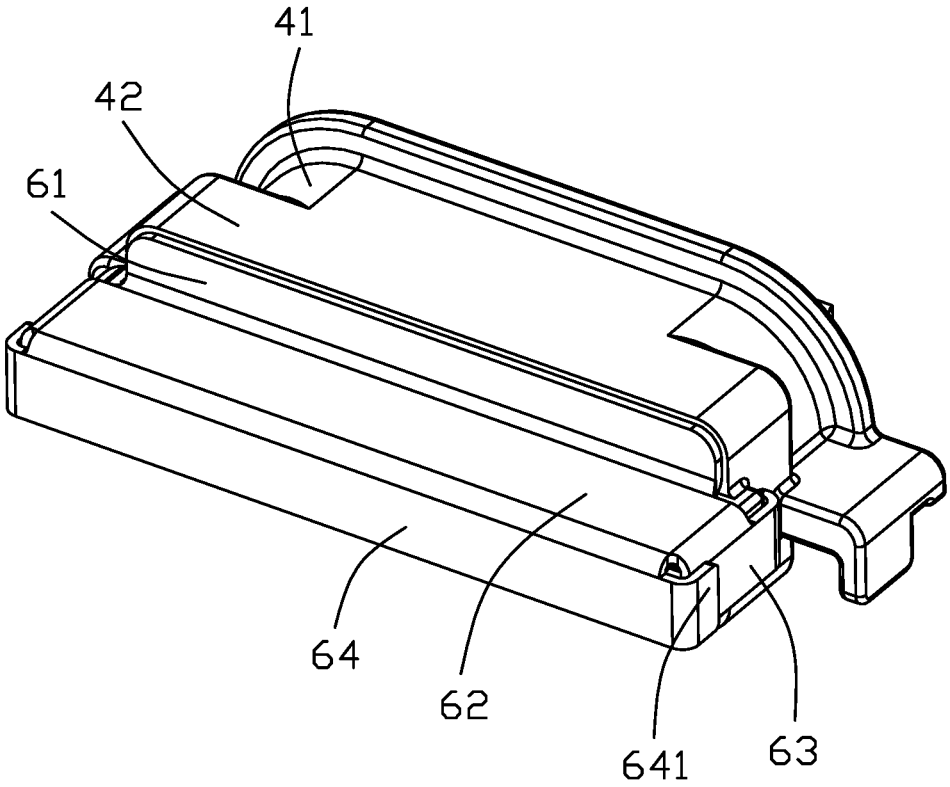
FIG. 4 is a rear perspective view of the electrical connector.
Figure 5:
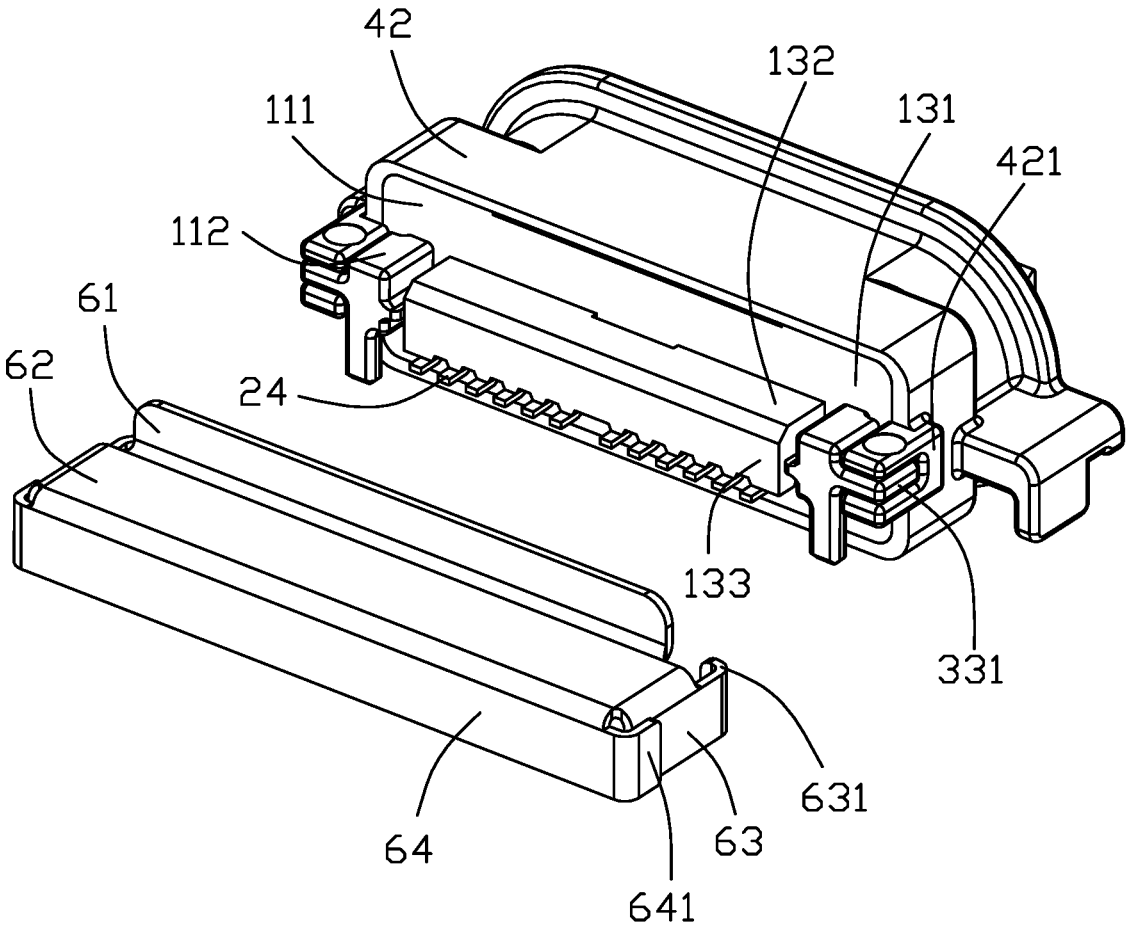
FIG. 5 is an exploded view of FIG. 4.
Figure 6:
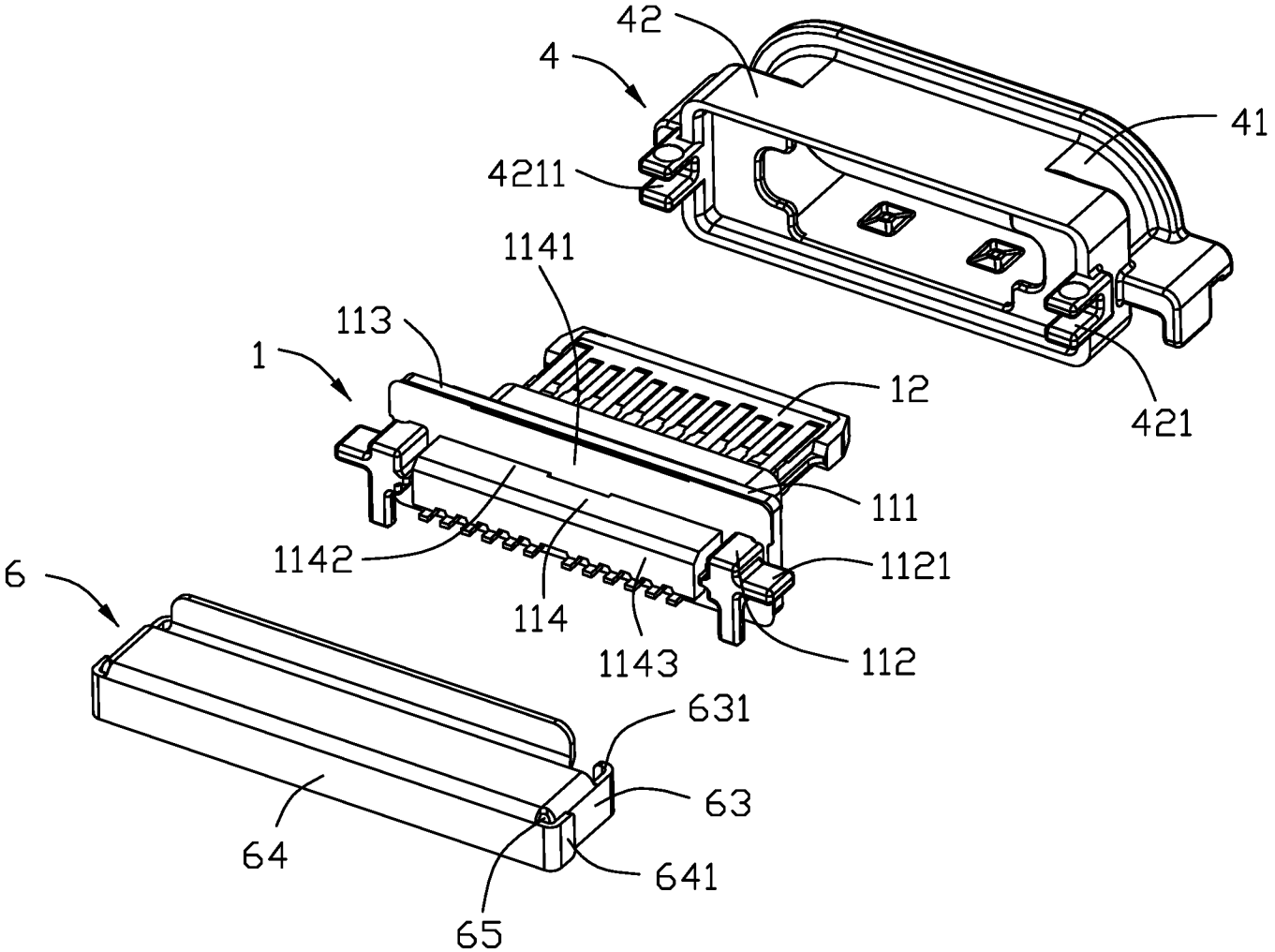
FIG. 6 is a further exploded view of FIG. 5.
Figure 7:
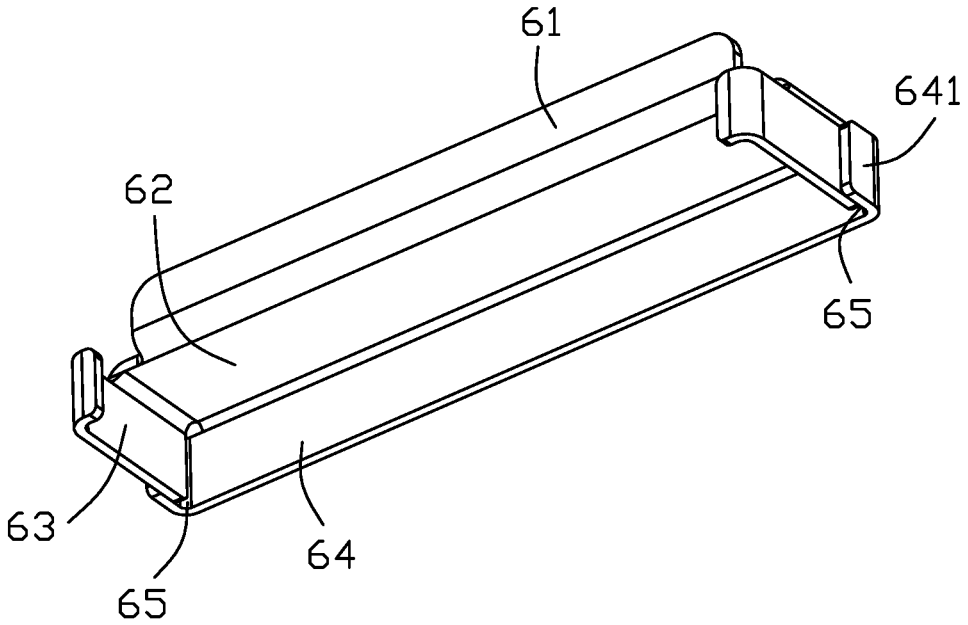
FIG. 7 is a perspective view of a rear shielding shell of the electrical connector.
Figure 8:
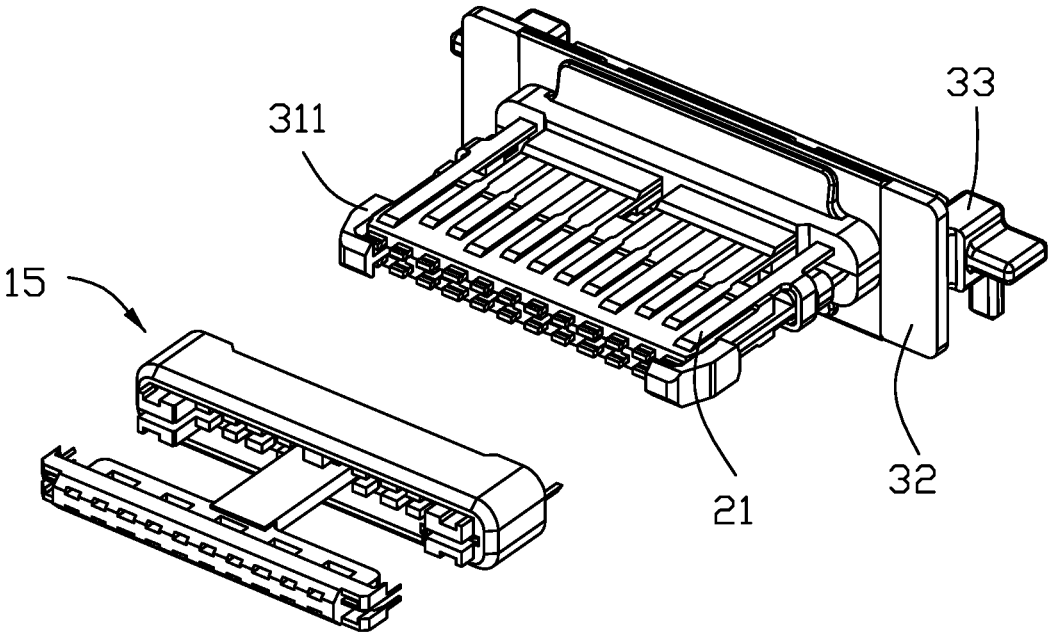
FIG. 8 is an exploded view of a housing and a plurality of contacts of the electrical connector.

Referring specifically to FIGS. 1-3, the housing 1 has a base 11 and a frontal tongue 12. The contact 2 has a contacting portion 23 exposed to a surface of the tongue 12, a tail 24, and an intermediate portion 25. The housing 1 may include a metal frame 3 having a main part 31. A pair of latches 311 extend from two front corners of the main part 31.

The base 11, together with the sealing element 5 if present, defines a periphery 113 and a rear end face 114. The base 11 has a front part 111 and a rear part 112. The rear part 112 has side surfaces 1121. The rear end face 114 has an upper surface 1141, a platform surface 1142, and a lower surface 1143. The periphery of the base 11 includes a periphery of the front part 111 and the side surfaces 1121 of the rear part 112. The front shielding shell 4 is fixed to and encloses the periphery of the base 11; the rear shielding shell 6 encloses the rear part 112 of the base 11 and shields the contacts 2.

The front shielding shell 4 is made of a metal injection molding process and includes a first tubular part 41, a second tubular part 42, and a pair of rear receptacles 421 each having a slot 4211. The rear part 112 of the base 11 extends rearwardly beyond the second tubular part 42 of the front shielding shell 4. The first tubular part 41 has a receiving space 40. At the junction of the first part 41 and the second part 42 is disposed a protruding wall. The protruding wall has a surrounding wall part profiled to accommodate the tongue 12 of the housing 1. A front face of the insulative housing base 11 abuts the wall part of the protruding wall.

The rear shielding shell 6 is made of a stamped metal sheet bent to form an intermediate part 62, a front part 61 continuing the intermediate part 62, a pair of side parts 63 continuing the intermediate part 62, and a rear part 64 continuing the intermediate part 62. There is a respective gap 65 between each of the two side parts 63 and the rear part 64. The rear part 64 further has a pair of flaps 641 at two opposite ends thereof covering overlapping the two side parts 63, thereby narrowing the gaps 65. Each side part 63 further has a hook 631 extending to a front of the receptacle 421 of the front shielding shell 4. The front part 61 of the rear shielding shell 6 forwardly abuts the front shielding shell 4.

Figure 9:
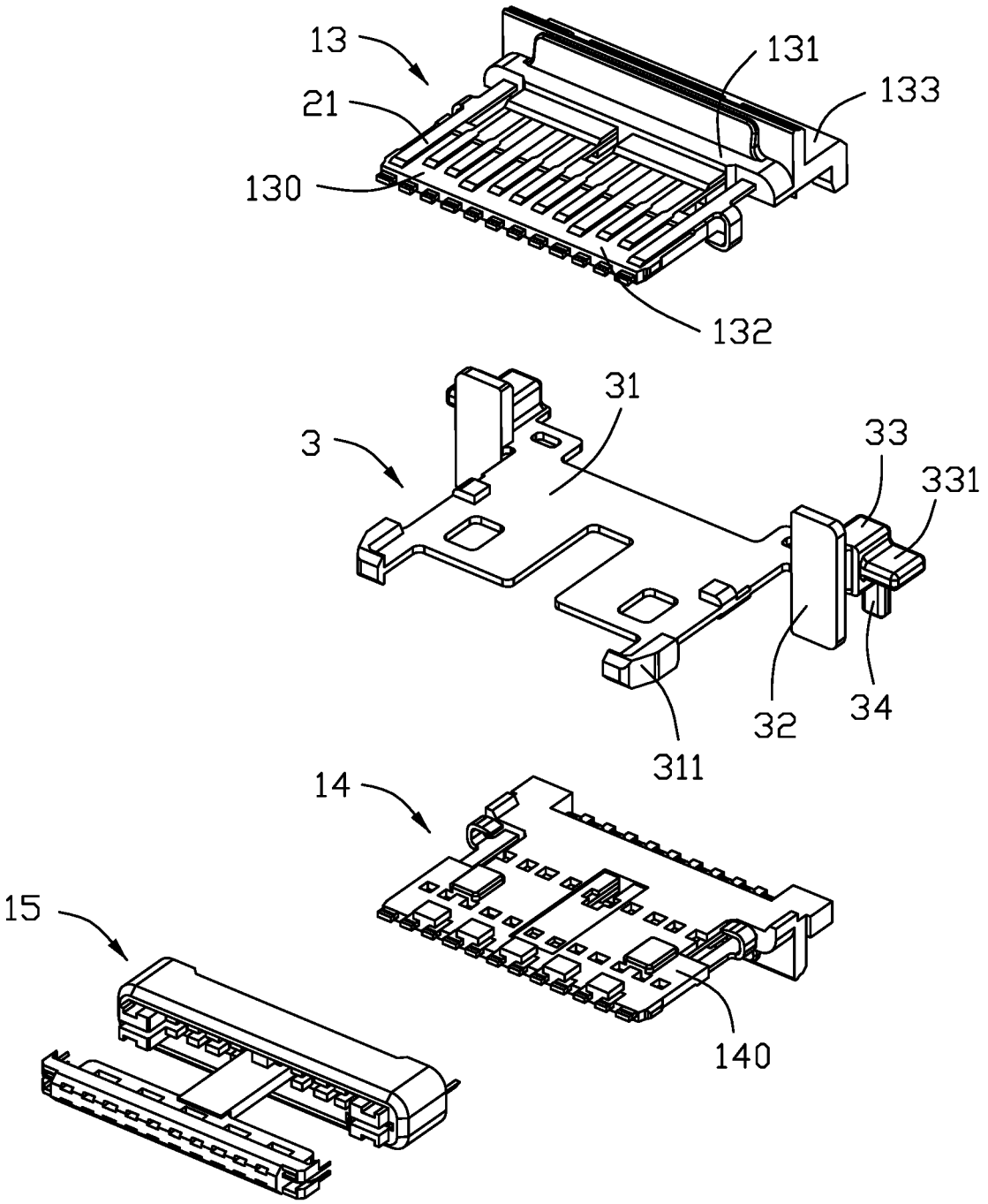
FIG. 9 is a further exploded view of FIG. 8.
Figure 10:
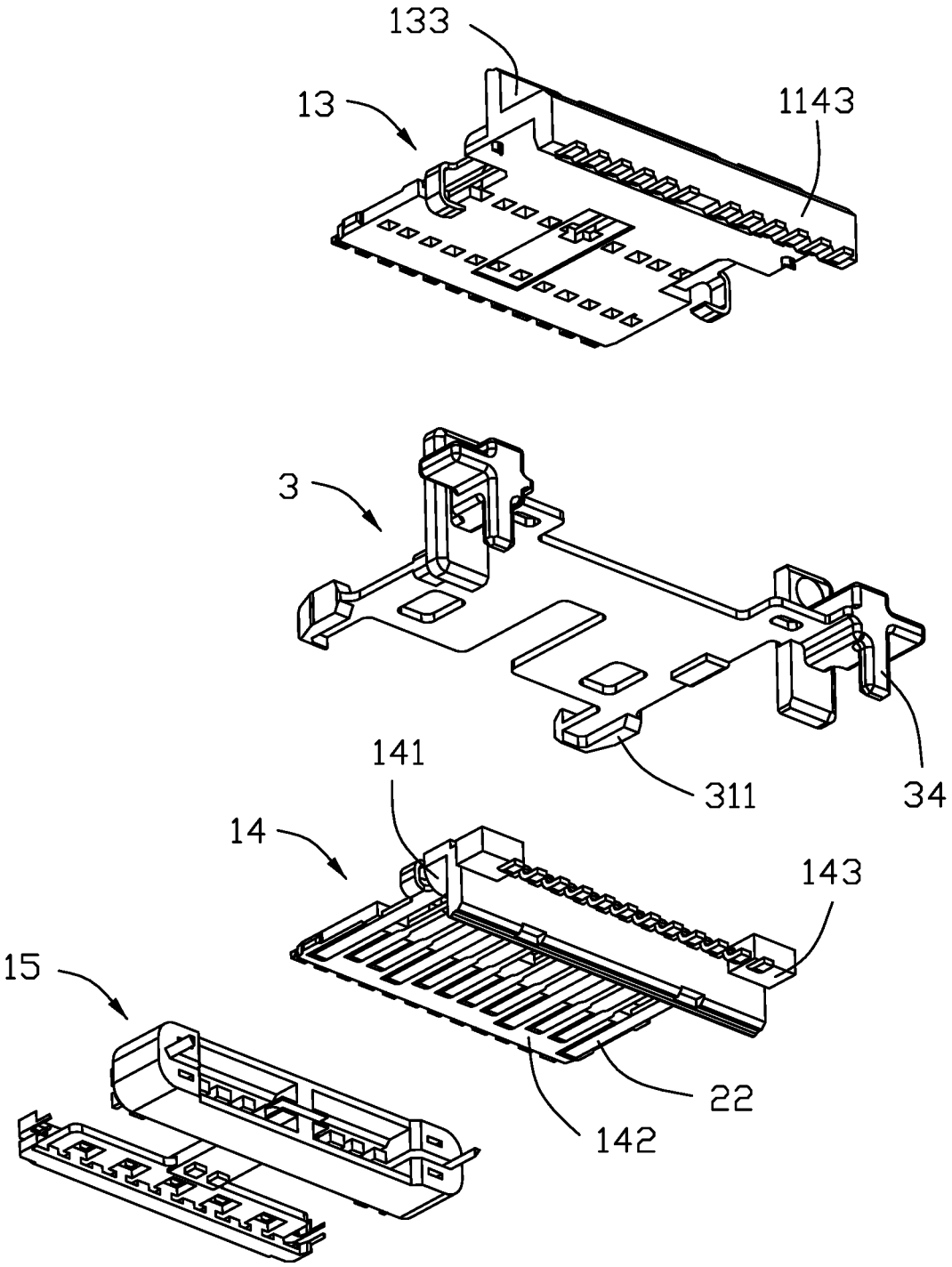
FIG. 10 is a view similar to FIG. 9 but from a different perspective.
Figure 11:
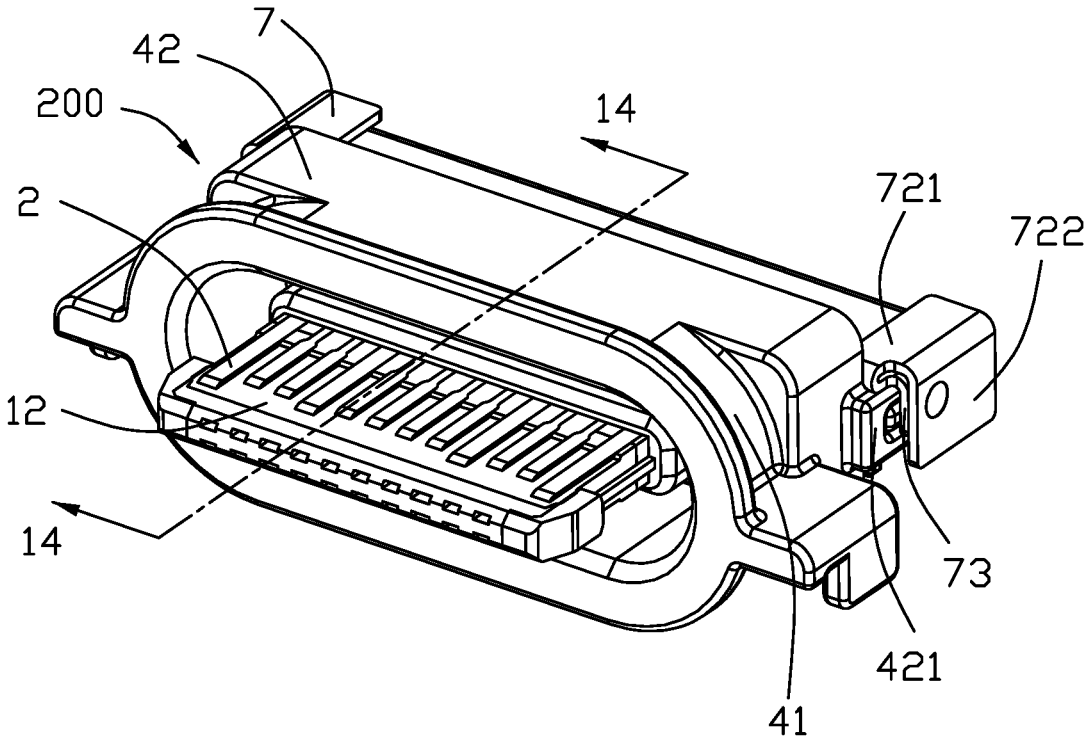
FIG. 11 is a front perspective view of an electrical connector in accordance with a second embodiment of the present invention.

Referring specifically to FIGS. 9-10, the contacts 2 includes an upper row of contacts 21 and a lower row of contacts 22. The upper row of contacts 21 are insert molded with an upper insulative body 130 to form an upper contact module 13; the lower row of contacts 22 are insert molded with a lower insulative body 140 to form a lower contact module 14.

The metal frame 3 has a main part 31 arranged to shield between the upper row of contacts 21 and the lower row of contacts 22, a pair of boards 32 at rear sides of the main part 31, a pair of rear mounts 33 behind the boards 32, and a pair of soldering legs 34. The board 32 is perpendicular to the main part 31 and a front face thereof abuts the wall part of the protruding wall. The rear mount 33 has a side protrusion 331 for engaging the slot 4211 of the receptacle 421.

The upper and lower contact modules 13 and 14 are mounted to an upper and lower sides of the metal frame 3. The main part 31 is sandwiched between the upper and lower insulative bodies 130 and 140 which in turn are confined between the pair of boards 32, as shown in FIG. 9. A third insulative body 15 is over-molded to the combined upper and lower contact modules 13 and 14 and the metal frame 3 to form the housing 1 carrying the contacts 2. The upper insulative body 130 has a front base part 131, a tongue part 132, and a rear base part 133; the lower insulative body 140 has a front base part 141, a tongue part 142, and a rear base part 143. The two front base parts 131 and 141 and the pair of boards 32 constitute the front part 111 of the base 11; the two rear base parts 133 and 143 and the pair of rear mounts 33, including the sealing element 5 if present, constitute the rear part 112 of the base 11.

Figure 15:
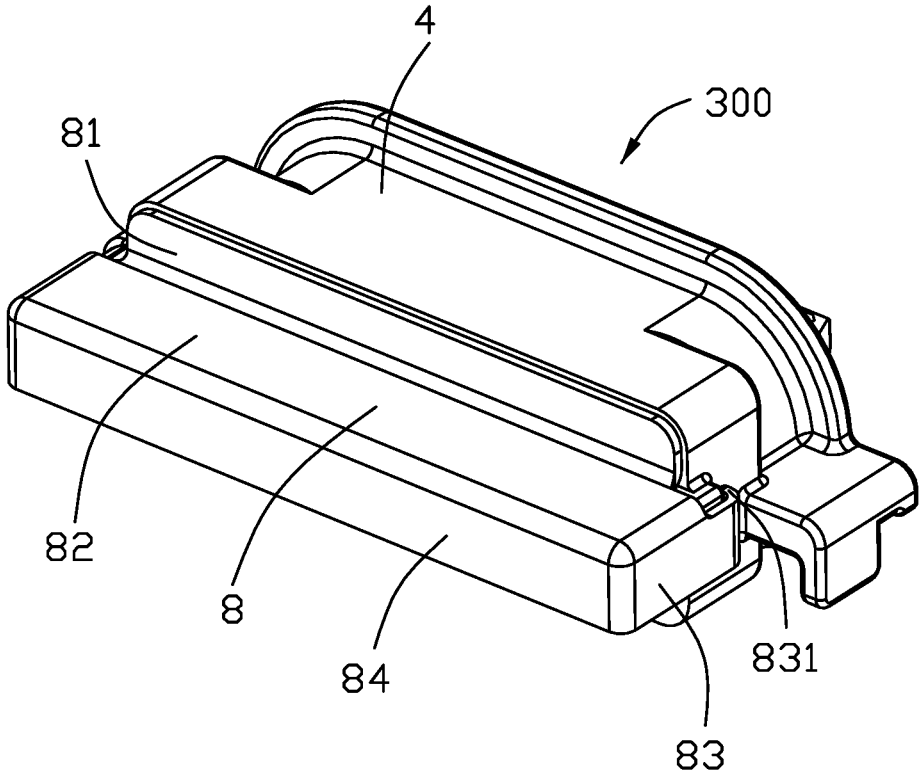
FIG. 15 is a rear perspective view of an electrical connector in accordance with a third embodiment of the present invention.
Figure 16:
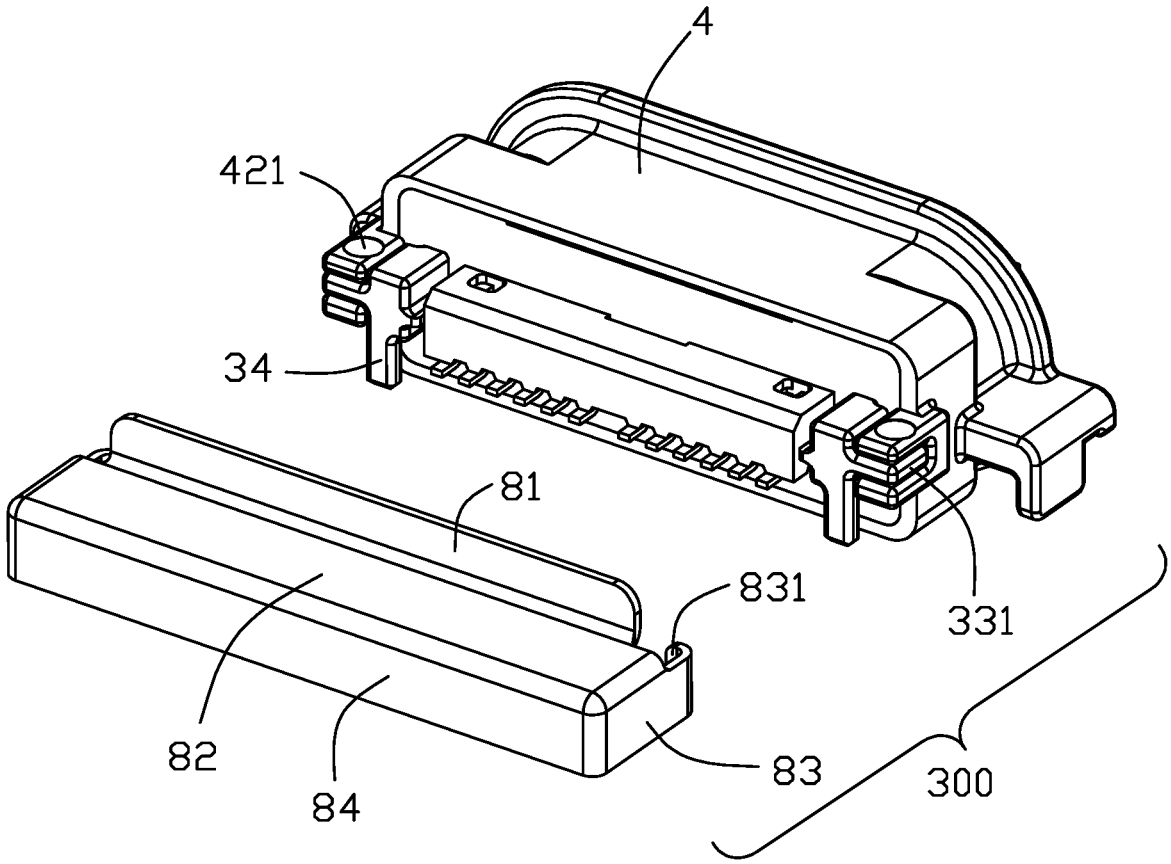
FIG. 16 is an exploded view of FIG. 15.
Figure 17:
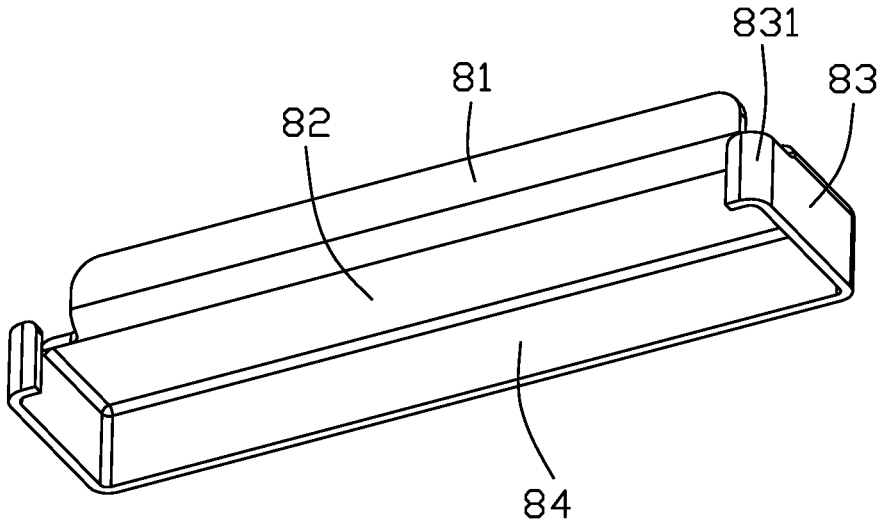
FIG. 17 is a perspective view of a rear shielding shell of the electrical connector in FIG. 15.
Figure 18:
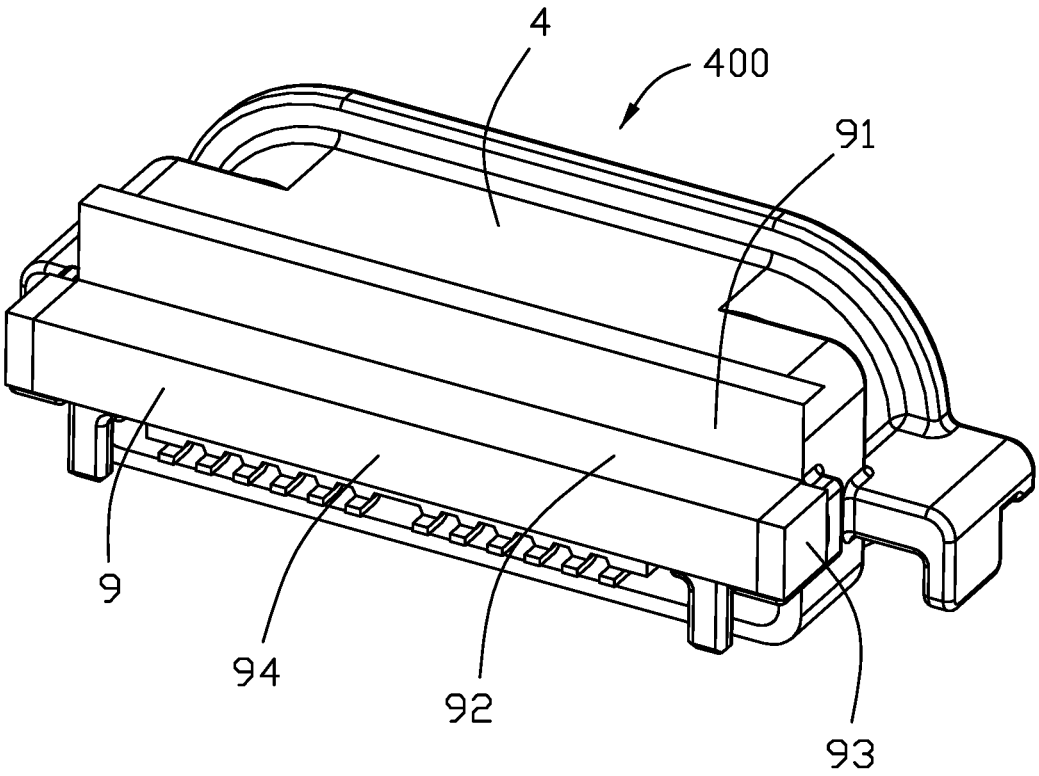
FIG. 18 is a rear perspective view of an electrical connector in accordance with a fourth embodiment of the present invention.
Figure 19:
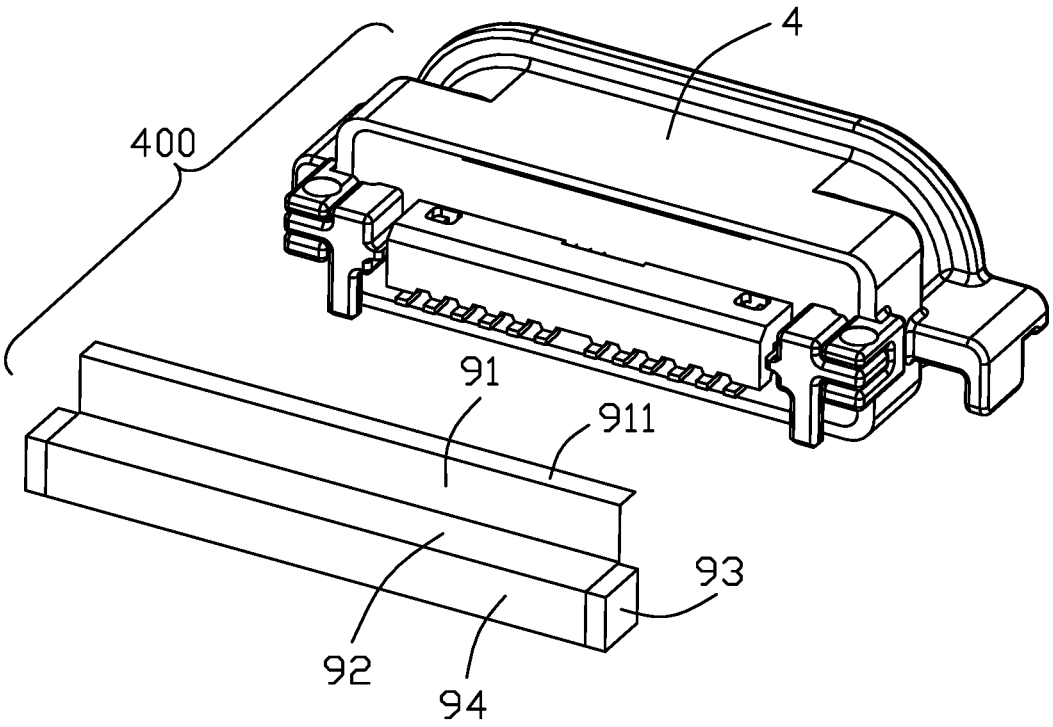
FIG. 19 is an exploded view of FIG. 18.
Figure 20:
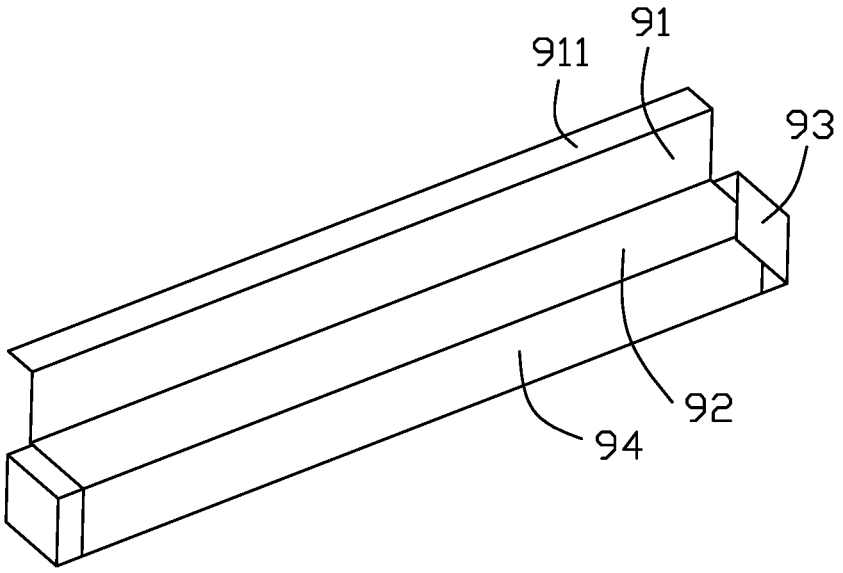
FIG. 20 is a perspective view of a rear shielding shell of the electrical connector in FIG. 18.

FIGS. 11-14 show an electrical connector 200 of a second embodiment. FIGS. 15-17 show an electrical connector 300 of a third embodiment. FIGS. 18-20 show an electrical connector 400 of a fourth embodiment. The housings and front shielding shells of the electrical connectors 200, 300, and 400 are same as the housing 1 and the front shielding shell 4 of the electrical connector 100 and therefore their description will not be repeated here.

Referring to FIGS. 11-14, the electrical connector 200 has a rear shielding shell 7 made of a metal sheet bent to form an intermediate part 72, a front part 71 continuing the intermediate part 72, a pair of side parts 73 continuing the intermediate part 72, and a rear part 74 continuing the intermediate part 72. The front part 71 is bent upward from a front of the intermediate part 72; the pair of side parts 73 are bent downward from left and right side ends of the intermediate part 72; the rear part 74 is bent downward from the intermediate part 72. The intermediate part 72 further has a pair of flaps 721 bent backward and associated flaps 722 bent downward from the flaps 721 to overlap the side parts 73. The flap 722 covers a respective gap 75 between the side part 73 and the rear part 74.

Figure 12:
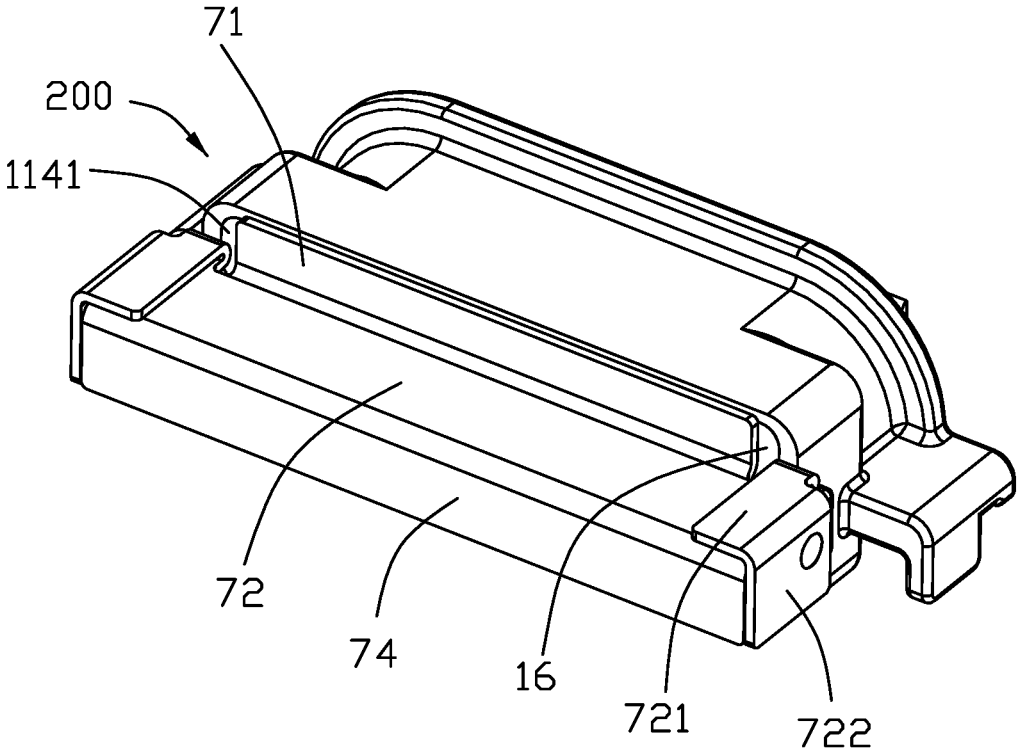
FIG. 12 is a rear perspective view of the electrical connector in FIG. 11.
Figure 13:
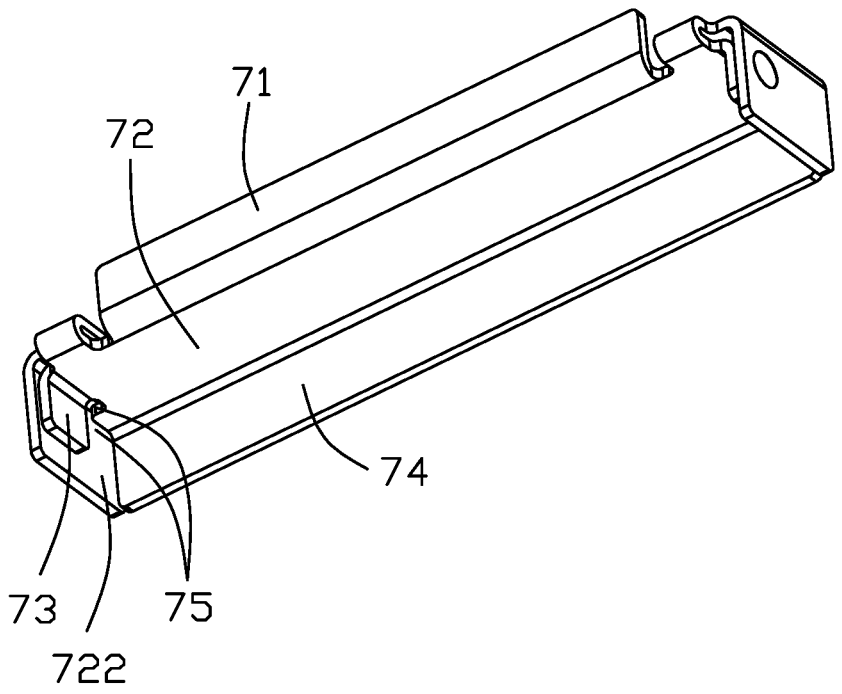
FIG. 13 is a perspective view of a rear shielding shell of the electrical connector in FIG. 11.
Figure 14:
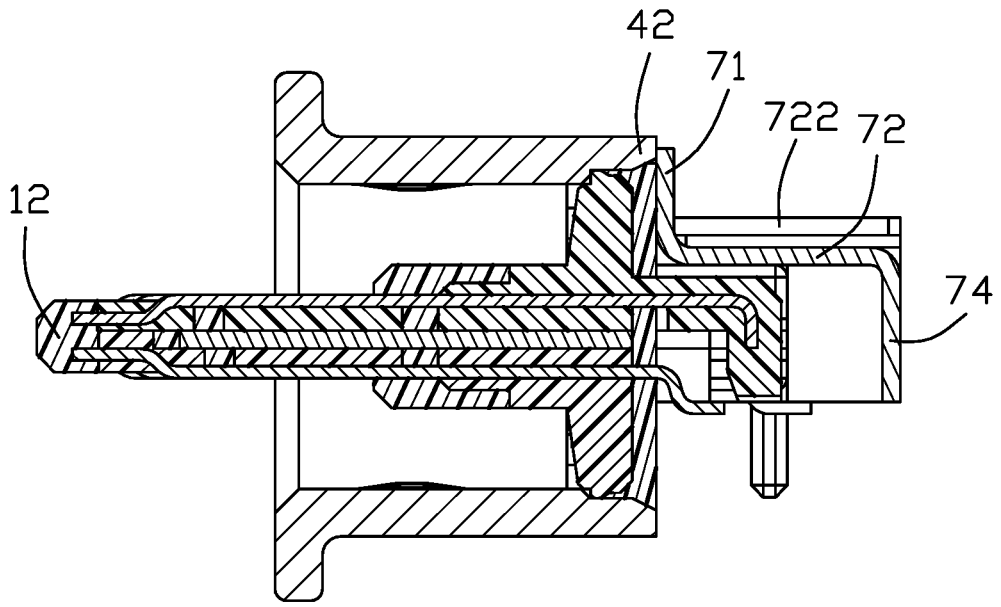
FIG. 14 is a cross-sectional view of the electrical connector in FIG. 11 taken along line B-B thereof.

Referring specifically to FIG. 12, due to presence of the flap 721, there exists another gap 16 beside the front part 71. The board 32 of the metal frame 3 is situated right in front of the gap 16 to provide proper shielding.

Referring to FIGS. 15-17, the electrical connector 300 has a rear shielding shell 8 made of a metal injection molding process to form an intermediate part 82, a front part 81 continuing the intermediate part 82, a pair of side parts 83 continuing the intermediate part 82, and a rear part 84 continuing the intermediate part 82. The front part 81 is angled upward from a front of the intermediate part 82; the pair of side parts 83 are angled downward from left and right side ends of the intermediate part 82; the rear part 84 is angled downward from the intermediate part 82. Each side part 83 further has a hook 831 extending to a front of the receptacle 421 of the front shielding shell 4.

Since the rear shielding shell 8 is made of a metal injection molding process, there is not any gap. A good shielding effect is expected.

Referring to FIGS. 18-20, the electrical connector 400 has a rear shielding shell 9 made of a metal film folded to have an intermediate part 92, a front part 91 continuing the intermediate part 92, a pair of side parts 93 continuing the intermediate part 92, and a rear part 94 continuing the intermediate part 92. The front part 91 is angled upward from a front of the intermediate part 92; the pair of side parts 93 are angled downward from left and right side ends of the intermediate part 92; the rear part 94 is angled downward from the intermediate part 92. The intermediate part 92 has a front extension 911 wrapping an upper rear end of the front shielding shell 4.

Since the rear shielding shell 9 has good malleability and foldability, good shielding effect is expected.

What is claimed is:

1. An electrical connector comprising:

a housing having a base and a frontal tongue, the base having a front part and a rear part;

an upper and lower rows of contacts arranged in the housing and exposed respectively to two opposite surfaces of the tongue; and a front and rear shielding shells enclosing the housing; wherein the rear shielding shell has an intermediate part, a front part continuing the intermediate part, a pair of side parts continuing the intermediate part, and a rear part continuing the intermediate part;

the housing includes a metal frame having a main part arranged to shield between the upper row of contacts and the lower row of contacts, a pair of boards arranged at two opposite outer sides of the front part of the base, and a pair of rear mounts;

the upper and lower rows of contacts have respective tails located inwardly of the pair of rear mounts;

the front shielding shell has a pair of rear receptacles engaging the pair of rear mounts;

the front shielding shell includes a first part, a second part, and a protruding wall at a junction of the first and second parts, the rear part of the base extending rearwardly beyond the second part of the front shielding shell; and the pair of boards abut the protruding wall.

2. The electrical connector as claimed in claim 1, wherein the front part of the rear shielding shell forwardly abuts the front shielding shell.

3. The electrical connector as claimed in claim 1, wherein the front part of the rear shielding shell has a front extension wrapping an upper rear end of the front shielding shell.

4. The electrical connector as claimed in claim 1, wherein the rear shielding shell is made of a metal sheet bent to form the intermediate part, the front part, the pair of side parts, and the rear part.

5. The electrical connector as claimed in claim 1, wherein the rear shielding shell is made of a metal injection molding process to form the intermediate part, the front part, the pair of side parts, and the rear part.

6. The electrical connector as claimed in claim 1, wherein the rear shielding shell is made of a metal film folded to have the intermediate part, the front part, the pair of side parts, and the rear part.

7. An electrical connector comprising:

a housing having a base and a frontal tongue, the base having a front part and a rear part;

an upper and lower rows of contacts arranged in the housing and exposed respectively to two opposite surfaces of the tongue; and a front and rear shielding shells enclosing the insulative housing; wherein the rear shielding shell forwardly abuts the front shielding shell;

the housing includes a metal frame having a main part arranged to shield between the upper row of contacts and the lower row of contacts, a pair of boards arranged at two opposite outer sides of the front part of the base, and a pair of rear mounts;

the upper and lower rows of contacts have respective tails located inwardly of the pair of rear mounts;

the front shielding shell has a pair of rear receptacles engaging the pair of rear mounts;

the front shielding shell includes a first part, a second part, and a protruding wall at a junction of the first and second parts, the rear part of the base extending rearwardly beyond the second part of the front shielding shell; and the pair of boards abut the protruding wall.

8. The electrical connector as claimed in claim 7, wherein the rear shielding shell is made of a metal sheet bent to form the intermediate part, the front part, the pair of side parts, and the rear part.

9. The electrical connector as claimed in claim 7, wherein the rear shielding shell is made of a metal injection molding process to form the intermediate part, the front part, the pair of side parts, and the rear part.

10. The electrical connector as claimed in claim 7, wherein the rear shielding shell is made of a metal film folded to have the intermediate part, the front part, the pair of side parts, and the rear part.

11. The electrical connector as claimed in claim 7, wherein the rear shielding shell includes an intermediate part, a front part continuing the intermediate part, a pair of side parts continuing the intermediate part, and a rear part continuing the intermediate part, and the front part forwardly abuts the front shielding shell.

12. The electrical connector as claimed in claim 11, wherein the front part of the rear shielding shell has a front extension wrapping an upper rear end of the front shielding shell.

* * * * *